US006598837B1

(12) United States Patent
Howard et al.

(10) Patent No.: US 6,598,837 B1
(45) Date of Patent: Jul. 29, 2003

(54) INFANT NURSING BOTTLE HOLDER AND MOBILE SUPPORT

(76) Inventors: Morris J. Howard, P.O. Box 226, Oak City, UT (US) 84649; Evelyn L. Howard, P.O. Box 226, Oak City, UT (US) 84649

( * ) Notice: Subject to any disclaimer, the term of this patent is extended or adjusted under 35 U.S.C. 154(b) by 0 days.

(21) Appl. No.: 10/003,854

(22) Filed: Dec. 6, 2001

(51) Int. Cl.[7] ..... A47D 15/00; A61J 9/06; E04G 3/00

(52) U.S. Cl. ..... 248/103; 248/102; 248/276.1; 248/292.12

(58) Field of Search ..... 248/102, 103, 248/104, 276.1, 282.1, 292.2, 422; 403/103, 104, 96, 97, 359.1, 93, 464; 74/575, 578, 527, 530, 531

(56) References Cited

U.S. PATENT DOCUMENTS

| | | | | | |
|---|---|---|---|---|---|
| 986,445 | A | | 3/1911 | Dexle | |
| 1,020,136 | A | | 3/1912 | Feely | |
| 1,151,920 | A | | 8/1915 | Barton | |
| 1,407,681 | A | | 2/1922 | Saunders | |
| 1,590,227 | A | | 6/1926 | Britton | |
| 1,737,468 | A | | 11/1929 | Xcananey | |
| 1,741,937 | A | | 12/1929 | Hill | |
| 1,863,163 | A | | 6/1932 | Welita et al. | |
| 2,110,037 | A | | 3/1938 | DeRosa | |
| 2,272,319 | A | | 2/1942 | Elzeer | |
| 2,412,423 | A | * | 12/1946 | Rayko | 248/105 |
| 2,470,694 | A | * | 5/1949 | Foo | 248/1 |
| 2,605,069 | A | | 7/1952 | Gillaspy | |
| 2,711,872 | A | * | 6/1955 | Lampke | 248/103 |
| 2,830,781 | A | * | 4/1958 | Coulter | 248/103 |
| 2,881,999 | A | * | 4/1959 | Mitchell | 248/106 |
| 2,912,200 | A | * | 11/1959 | Reinhorn | 248/103 |
| 2,989,278 | A | * | 6/1961 | Hyman | 61/961 |
| D197,829 | S | | 3/1964 | Demos et al. | |
| 3,564,759 | A | * | 2/1971 | Buttermore | 46/32 |
| 3,627,244 | A | * | 12/1971 | Nicholas | 248/103 |
| 3,990,550 | A | * | 11/1976 | Recker | 192/46 |
| 3,993,274 | A | | 11/1976 | Jansen | |
| 4,156,391 | A | * | 5/1979 | Ubezio | 108/136 |
| D273,044 | S | | 3/1984 | Holcomb | |
| 4,458,870 | A | * | 7/1984 | Duncan | 248/279 |
| D277,700 | S | | 2/1985 | Heber et al. | |
| 4,706,915 | A | * | 11/1987 | Cincric | 248/122 |
| 4,735,388 | A | * | 4/1988 | Marks | 248/103 |
| 4,750,696 | A | | 6/1988 | Shan-Liang et al. | |
| 4,865,239 | A | | 9/1989 | Timbrook | |
| 4,869,381 | A | * | 9/1989 | Agner | 215/11.1 |
| 4,875,697 | A | * | 10/1989 | Miller | 280/86.758 |
| D309,018 | S | | 7/1990 | Leach | |
| 4,951,997 | A | * | 8/1990 | Kenney | 297/188 |
| 4,957,253 | A | | 9/1990 | Roy et al. | |
| D313,472 | S | | 1/1991 | Pierce | |
| 4,989,811 | A | | 2/1991 | Mills | |
| 5,037,046 | A | | 8/1991 | Mingleforff | |
| 5,083,732 | A | | 1/1992 | Akamine | |
| 5,092,549 | A | * | 3/1992 | Beech | 248/103 |
| 5,098,049 | A | * | 3/1992 | van Vlaardingen | 248/123.1 |
| D326,524 | S | | 5/1992 | Lawal et al. | |
| 5,135,189 | A | | 8/1992 | Ghazizadeh | |
| D331,112 | S | | 11/1992 | Carver | |

(List continued on next page.)

*Primary Examiner*—Leslie A Braun
*Assistant Examiner*—Amy J. Sterling
(74) *Attorney, Agent, or Firm*—Angus C. Fox, III

(57) ABSTRACT

An infant nursing bottle holder includes a substantially U-shaped clamping member, a substantially Y-shaped nursing bottle-retaining member, a strap for securing an infant nursing bottle to the bottle-retaining member, multiple elongate members, interconnected end-to-end and, together, coupling the bottle-retaining member to the U-shaped clamping member, and a rotatable hinge joint at the interconnection of each pair of elongate members, each hinge joint having a geared resilient pivot that permits angular positioning of the joined elongate members at discrete arcuate intervals through a range of at least 180 degrees.

20 Claims, 7 Drawing Sheets

U.S. PATENT DOCUMENTS 5,192,041 A 3/1993 Bryant
5,217,192 A 6/1993 Oktayuren
D338,733 S 8/1993 Carpio
D345,423 S 3/1994 Sabalones
D345,800 S 4/1994 Mills
D351,657 S 10/1994 Griffin
D353,462 S 12/1994 McBeth
5,370,570 A * 12/1994 Harris ..... 446/227
5,375,357 A * 12/1994 Butcher et al. ..... 40/661.06
D358,892 S 5/1995 Kahn
5,489,075 A 2/1996 Ible
D369,413 S 4/1996 Lodewyck et al.
D375,796 S 11/1996 Beaver
D382,970 S 8/1997 Agopian
5,664,746 A 9/1997 Benzakarya
5,709,360 A * 1/1998 Rosen ..... 248/278.1
D403,427 S 12/1998 Pring
D413,984 S 9/1999 Lindsey
D414,559 S 9/1999 Zefferino
D417,778 S 12/1999 Karlin, III
6,073,788 A * 6/2000 Stroud ..... 215/11.1
D438,626 S 3/2001 Broussard et al.
D439,671 S 3/2001 Casillo et al.
6,213,547 B1 4/2001 Bowe et al.
6,234,907 B1 * 5/2001 Moser ..... 464/134
D443,933 S 6/2001 Schindler
6,296,312 B1 * 10/2001 Congleton et al. ..... 297/411.35
6,343,807 B1 * 2/2002 Rathbun ..... 280/276

* cited by examiner

INFANT NURSING BOTTLE HOLDER AND MOBILE SUPPORT

BACKGROUND OF THE INVENTION

1. Field of the Invention

The present invention relates to holding devices in general and, more particularly, to cantilevered support devices for infant feeding bottles and the like.

2. Description of the Prior Art

Infants require frequent periodic feedings throughout the day, which may or may not fit the schedule of available free time of the parent or other caregiver. Although evidence strongly suggests that infants, who are completely deprived of the touch, closeness and voice of other human beings, are likely to be social misfits, there is no indication that, if the parent or other caregiver is not with the child every waking hour of its day, the child will suffer irreversible emotional, psychological or intellectual harm. Consequently, many time saving devices have been developed to assist those who care for young children so that they are not an all consuming task. For example, bottle holders have been developed so that an infant may be fed without an attendant having to hold the bottle. Such a device is especially useful when an infant is being transported in a carriage or stroller, or when the infant is lying in a crib.

The prior art is replete with examples of various types of bottle holders. For example, U.S. Pat. No. 4,735,388 to Marks discloses a bottle holding apparatus having a first clamping device for attaching the apparatus to an object near the infant, a second clamping device for securing a feeding bottle, and an articulated support structure having multiple telescoping beams connecting the two clamping devices. U.S. Des. Pat. No. 273,044 to Holcomb discloses a device similar to that of Marks, but sans the telescoping feature of the beams. U.S. Des. Pat. No. 369,413 to Lodewyck, Jr., et al. and U.S. Des. Pat. No. 443,933 to Schindler both disclose bottle holding devices in which a clip is attached to a bottle retainer via a shapable member. U.S. Des. Pat. No. 345,800 to Mills discloses a baby bottle holder which includes a movable arm to which the bottle may be attached, the arm connected to the apex of an adjustable A-frame. U.S. Des. Pat. No. 345,423 to Sabalones discloses a baby bottle holder having a weighted base coupled to a bottle holding clamp with a shapable tubular member. U.S. Des. Pat. No. 326,524 to Lawal discloses a baby bottle holder having a clamp coupled to a bottle holding clamp with a shapable tubular member. U.S. Pat. No. 3,627,244 to Nicholas discloses a very industrial looking baby bottle holder that includes a collar for holding a bottle, a yoke in which the collar is pivotally mounted, and a clamp coupled to the yoke via a pair of arms interconnected by a slidable joint. U.S. Pat. No. 2,605,069 to Gillaspy discloses a nursing bottle holder having a screw-type clamp for attaching the device to a crib rail or other similar fixed article, the clamp being attached to a flexible resilient forked clamp for holding a bottle with a pair of adjustably movable jointed arms equipped with screw-type tensioning knobs. U.S. Pat. No. 1,741,937 to Hill discloses a baby bottle holder having a bottle retainer fabricated from a continuous length of metal rod, that is coupled to a screw type clamp with a pair of jointed flat arms. U.S. Pat. No. 986,445 to Dekle discloses a nursing bottle holder having either a weighted base of a clamp connected to a spring clamp via an articulated structure of interconnected flat metal strips.

In spite of the existence of dozens of U.S. patents which disclose baby bottle holders, it is likely that all have fallen short of consumer expectations as few, if any, are commercially available. One of the noted problems with many of the patented devices may be their complexity, which translates to retail costs which may be higher than the average consumer is willing to pay. In addition, some appear to be sufficiently heavy as to pose a danger to the infant were they to become inadvertently unsecured while in use. Another perceived problem with many of the bottle holding devices is that adjustment to fit the particular situation is time consuming and inconvenient.

What is needed is a practical adjustable infant nursing bottle holder that is safe, simple, lightweight, inexpensive to manufacture, and easily adjustable.

SUMMARY OF THE INVENTION

The present invention, which answers the heretofore expressed need for a practical infant nursing bottle holder apparatus, includes a U-shaped clamp having a central clamp portion and first and second generally parallel and opposed extensive portions integral with the central portion. The first extensive portion has a threaded aperture adapted to receive a threaded thumbscrew which is threadably movable perpendicular to the extensive portions. The thumbscrew may be fitted with a non-rotating load distributing member which slides between the two extensive portions. The central portion incorporates a first male snap connector member. The bottle holder apparatus further includes a generally U-shaped bottle retainer. The bottle retainer comprises a central retainer portion which incorporates a second male snap connector member and a pair of extensive retainer portions integral with the central portion retainer portion. A resilient strap releasably interconnects the free ends of the extensive retainer portions for securing a nursing bottle within the bottle retainer. The bottle holder apparatus further includes multiple interlinked arms, each pair of which are coupled with a swivel connector providing incremental arcuate positioning over a range greater than 180 degrees. The free end of each of the outermost arms incorporates a female snap connector which mates with either the first or second male snap connector. Each of the swivel connectors, which allows for simple reliable adjustments of the angle between a pair of interconnects arms, includes a first hinge member having an internally geared aperture with a first set of teeth. A second hinge member has an externally geared pivot shaft with a second set of teeth which passes through the internally geared aperture such that the first and second sets of teeth are mutually engaged, the pivot shaft being rigidly coupled at opposite ends to a pair of opposed, spaced apart hinge plates. The hinge plates are interconnected at some distance from the geared pivot shaft. At least the first hinge member is fabricated from a resilient material that deforms as the first hinge member is rotated about the pivot shaft. Alternatively, both the first hinge member and the pivot shaft may be fabricated from resilient materials, which may even be the same material.

PREFERRED EMBODIMENT OF THE INVENTION

The new nursing bottle holder and mobile support will now be described with reference to the attached drawing figures.

Figures 1, 2, 3, 4, 5:
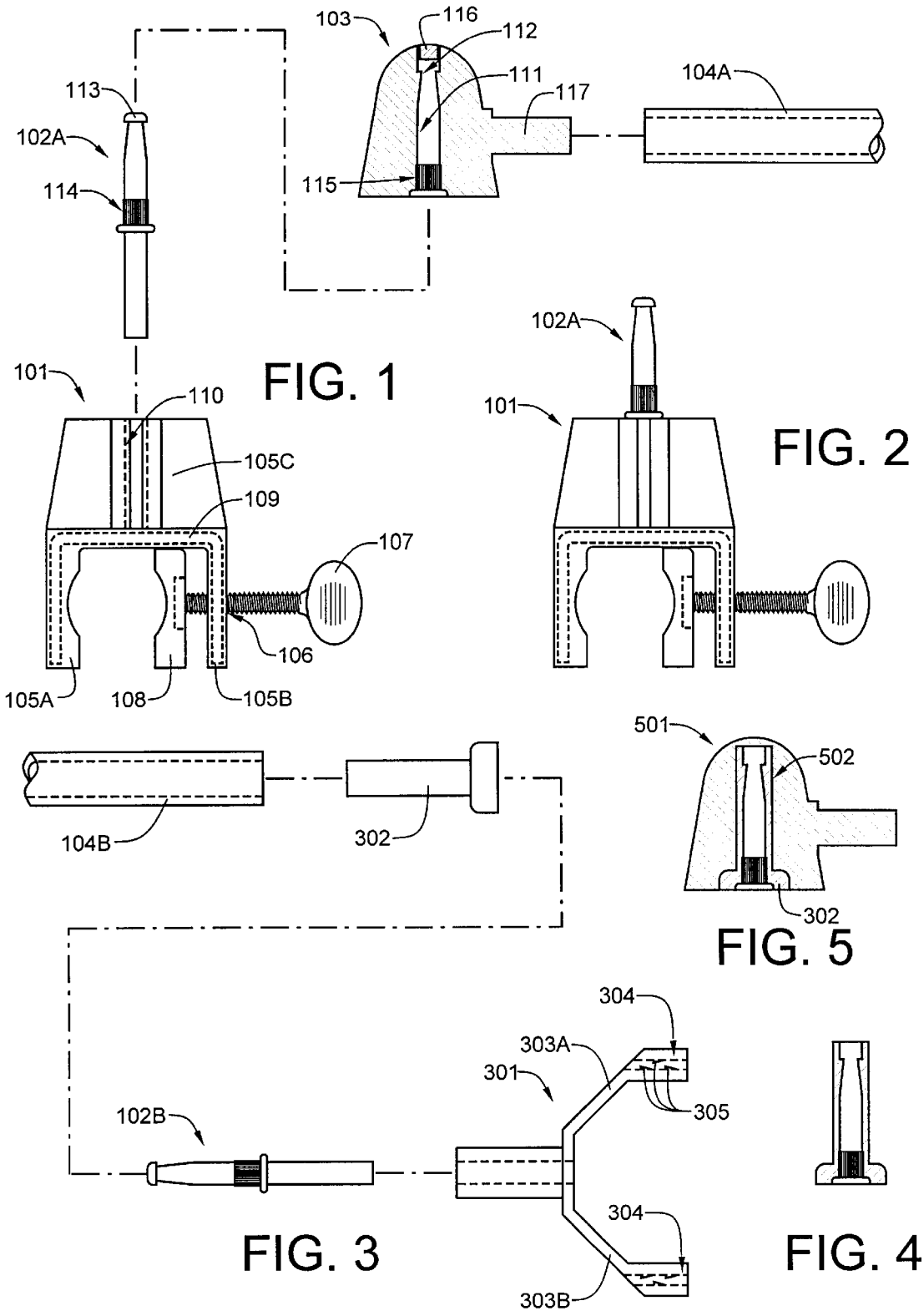
FIG. 1 is an exploded view of four of the components of a first embodiment infant nursing bottle holder, including a generally U-shaped clamp (shown as an elevational view showing a cylindrical cavity as a hidden feature), a first pivot pin, or male snap connector, insertable in the clamping portion (shown as an elevational view), a one-piece resilient female swivelable snap connector (shown in cross-section taken through its longitudinal axis), and a tube (shown as a partial elevational view showing the hidden inner walls) attachable to the female snap connector.
FIG. 2 is an elevational view of the clamp with the pivot pin installed therein.
FIG. 3 is an exploded view of four additional components of the infant nursing bottle holder, including a bottle holder (a plan view showing a cylindrical cavity as a hidden feature), a second pivot pin, or male snap connector, insertable in the clamping portion (shown as an elevational view), a resilient bushing insert, or second resilient female swivelable snap connector (shown in cross-section taken through its longitudinal axis), and a tube (shown as a partial elevational view showing the hidden inner walls)
FIG. 4 is a cross-sectional view of the resilient bushing insert.
FIG. 5 is an elevational view of a two-piece female snap connector.

Referring now to FIG. 1, this exploded view shows four components of the new nursing bottle holder, namely a generally U-shaped clamp 101, a first pivot pin, or male snap connector, 102A, a one-piece resilient female swivelable snap connector 103, and a portion of a first tubular elongate member 104A. The U-shaped clamp 101 has a central portion 105C and first and second generally parallel and opposed extensive portions 105A and 105B, respectively, both of which are integral with the central portion 105C. The second extensive portion 105B has a threaded aperture 106 adapted to receive a threaded thumbscrew 107, which is threadably movable perpendicular to the extensive portions 105A and 105B. The thumbscrew 107 may be fitted with a non-rotating load distributing member 108, which slides between the two extensive portions 105A and 105B. The central and extensive portions 105A, 105B, and 105C may be fabricated entirely from a structural metal such as stainless steel or heat-treated aluminum, or it may be fabricated from a polymeric plastic material and equipped with a U-shaped metal insert 109 (shown as a hidden feature), which provides structural strength and durability.

Still referring to FIG. 1, the first pivot pin 102A fits within a cylindrical aperture 110 in the central portion 105C of clamp 101. If the central portion 105C is fabricated entirely of metal, the pivot pin may be retained therein with an interference fit. If it is made of plastic, the pivot pin may be adhesively bonded with the aperture 110. A polyurethane adhesive is but one example of an adhesive that would work well for this application. The one piece, resilient female swivelable snap connector 103 has a generally cylindrical aperture 111, which tapers to an annular lip 112. As this aperture 111 is forced over the first pivot pin 102A, the tapered region which ends in the annular lip 111 deformably snapping over the domed retainer 113 of the pivot pin 102A and serving as a retention mechanism. The female snap connector 103 is able to swivel in an unrestricted arc about the pivot pin 102A. It will be noted that the pivot pin 102A also includes an externally geared region 114 having evenly angularly spaced longitudinally oriented teeth. The female snap connector 103, on the other hand, is equipped with an internally geared region 115 having evenly angularly spaced teeth that mesh with those of the externally geared region 114 of pivot pin 102A. If each component have 36 teeth, as the female snap connector 103 is rotated about the first pivot pin 102A, it jumps between 36 angular positions spaced 10 degrees apart. As the number of teeth is increased, the number of angular positions increases, but the longevity of the device and the force required to change angular positions decreases.

Still referring to FIG. 1, it will be noted that the female snap connector 103 has a trim plug 116 which covers the end of the aperture within the female snap connector 103. The female snap connector also has a horizontally disposed stub post 117 to which the first tubular elongate member 104A may be adhesively bonded. The tubular member 104A may be a length of polyvinylchloride pipe, or a length of structural metal tubing. Aluminum, mild steel, stainless steel, titanium, and magnesium are all structural metals that could be used. However, the goals of achieving low production cost, resistance to corrosion and a minimization of mass may indicate the use of a metal such as anodized aluminum.

Referring now to FIG. 2, the U-shaped clamp 101 is shown with the first pivot pin 102A affixed within the central portion 105C thereof.

Referring now to FIG. 3, this exploded view shows four additional components of the infant nursing bottle holder, namely a generally Y-shaped bottle retainer 301, a second pivot pin 102B identical to the first pivot pin 102A, a resilient bushing insert, or second resilient female swivelable snap connector 302, and a portion of a second tubular elongate member 104B. It will be noted that each of the arms 303A and 303B of the Y-shaped bottle retainer 301 is equipped with a strap receiving slot (shown as a hidden feature) 304. Each slot 304 has a plurality of internal barbs 305, which permit the end of a strap (not shown in this drawing figure) to be inserted, but not withdrawn from the slot.

Referring now to FIG. 4, this cross-sectional view of the resilient bushing insert 302 shows that the interior profile is identical to that of the female snap connector 103. This is understandable, as it deformably slips over the domed retainer 112 of the second pivot pin 102B.

Referring now to FIG. 5, a second embodiment female snap connector 501 a non-tapering cylindrical aperture 502 into which may be inserted a resilient bushing insert 302. The inserted bushing insert 302 may be held in place with adhesive or mechanical means (not shown). The second embodiment female snap connector 501 may be used in place of the first embodiment,female snap connector 103.

Figure 6:
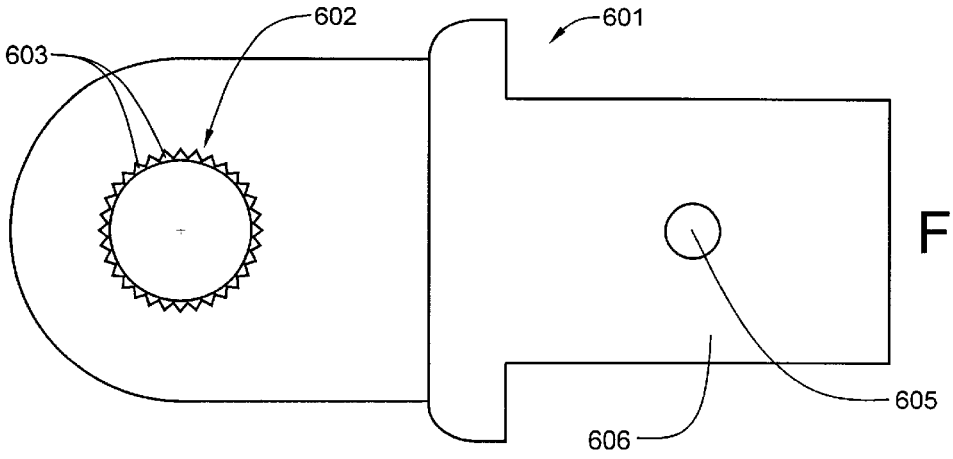
FIG. 6 is a top plan view of a lower portion of a male joint member.
Figure 7:
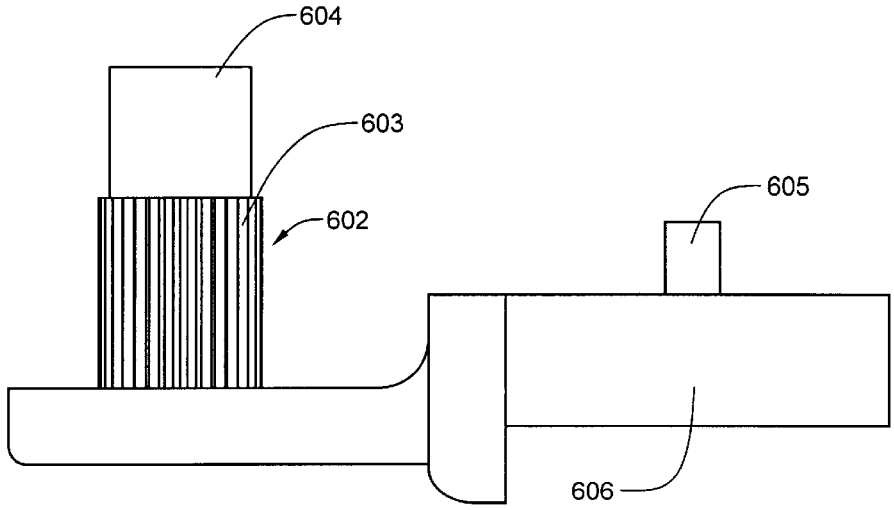
FIG. 7 is a side elevational view of the male joint member portion of FIG. 5.

Referring now to FIGS. 6 and 7, a first, or bottom, portion 601 of a male joint member (shown assembled in FIGS. 9 and 10) is shown in both top and side views, respectively. It will be noticed that the first portion 601 incorporates an externally-geared shaft 602 having equally angularly spaced external teeth 603, and an upper end 604. An alignment stub 605 projects from a connection plug portion 606.

Figure 8:
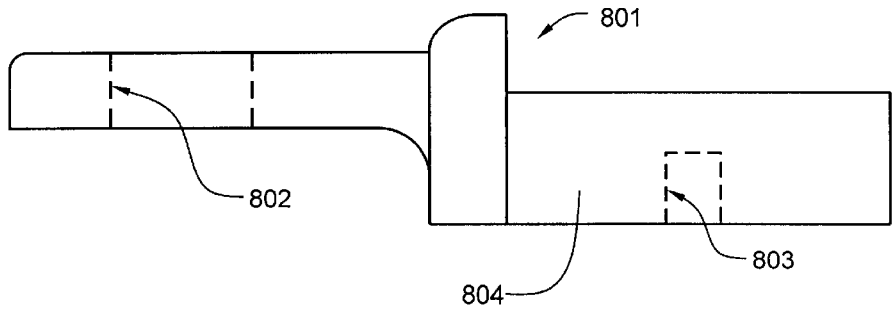
FIG. 8 is a side elevational view of an upper portion of a male joint member.

Referring now to FIG. 8, a second, or upper, portion 801 of a male joint member is shown in a side view. The second portion 801 has a first aperture 802 (shown with hidden lines) for receiving an upper end 604 of the geared shaft 602 and a second aperture 803 for receiving the alignment stub 605 (see FIGS. 6 and 7).

Figure 9:
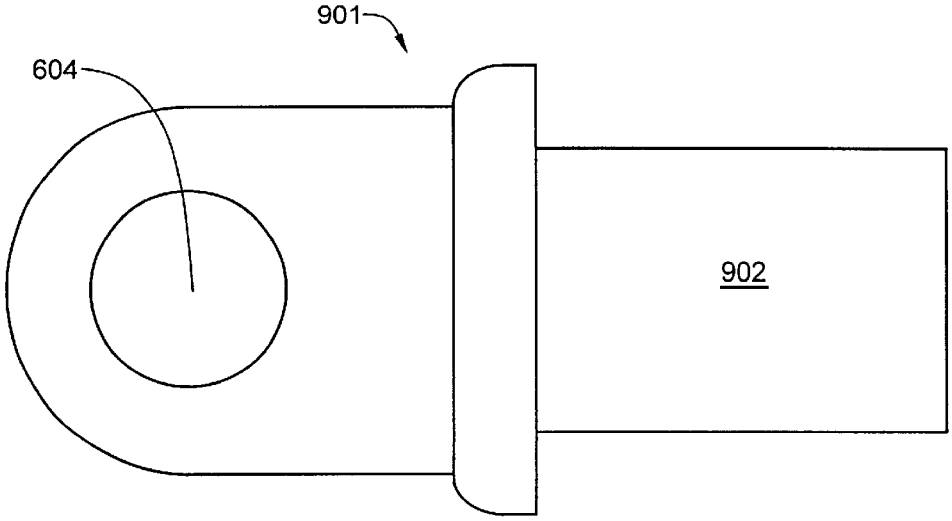
FIG. 9 is a top plan view of an assembled male joint member, consisting of the lower and upper male joint member portions of FIGS. 7 and 8.
Figure 10:
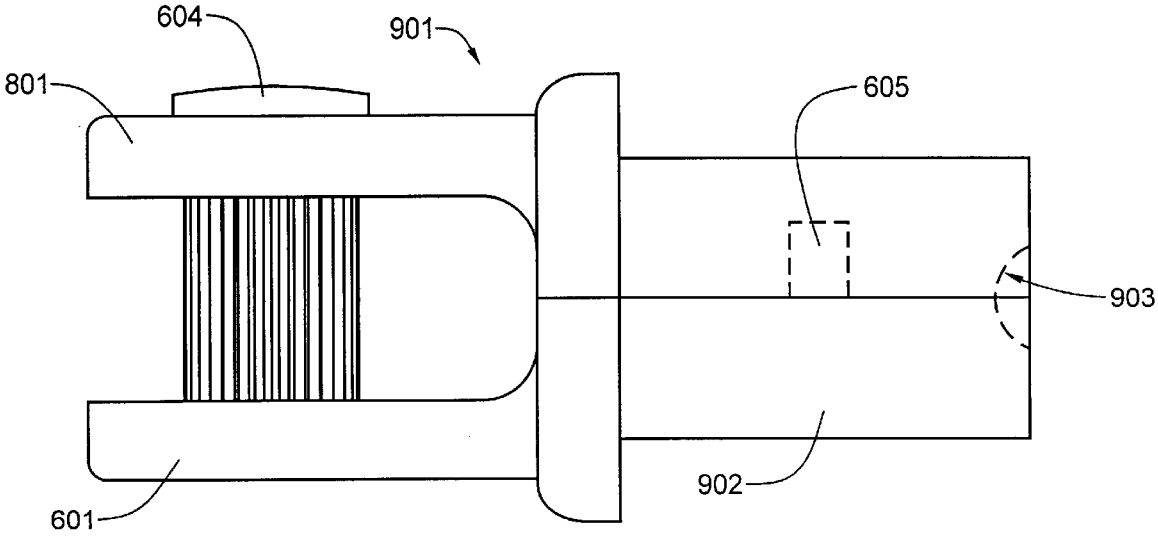
FIG. 10 is a side elevational view of the assembled male joint member of FIG. 9.

Referring now to FIGS. 9 and 10, an assembled male joint member 901 is shown in both top and side views, respectively. The first and second portions 601 and 801, respectively, of the male joint member are either chemically or thermally bonded together, forming a cylindrical male joint member connection plug 902. It will be noted that the upper end 604 of the geared shaft 602 has been melted and bonded to the upper portion 801 of the male joint member 901. It will also be noted that a thermally formed depression 903 at the connection plug end of the assembled male joint member 901 may be employed to permanently join the upper and lower portions 801 and 601, respectively. The alignment stub 605 (shown in a hidden view) maintains proper alignment of the two portions until they are bonded together.

Figure 11:
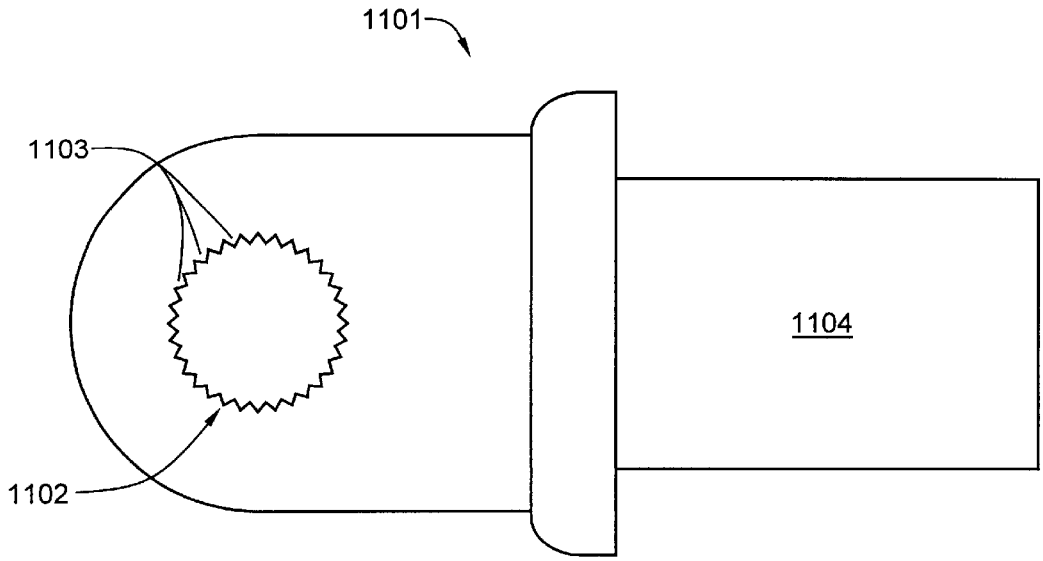
FIG. 11 is a top plan view of a female joint member.
Figure 12:
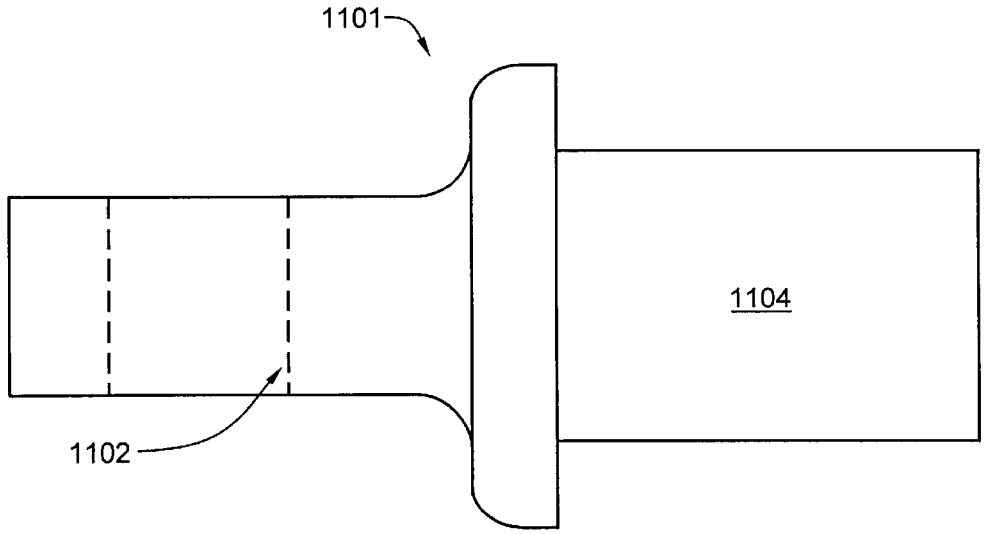
FIG. 12 is a side elevational view of the female joint member of FIG. 10.

Referring now to FIGS. 11 and 12, a female joint member 1101, made of resilient polymeric plastic material, is shown in both top and side views, respectively. It will be noted that the female joint member 1101 has a geared aperture 1102 with 32 will be noted that the female joint member 1101 has a geared aperture 1102 with 32 evenly angularly spaced internal teeth 1103. The female joint member 1101 is slipped onto the geared shaft 602 of the first, or bottom, male joint member portion 601 prior to the joining of the first and second male joint members 601 and 801, respectively. The internal teeth 1103 mesh with the external teeth 603 of the geared shaft 602, thereby providing 32 stable arcuate positions of the female joint member 1101 with respect to the male joint member 901. It should be noted that although it is essential that at least the female joint member 1101 be made of a resilient polymeric plastic material, such as nylon, polypropylene, polycarbonate, or polyethylene, both the male and female joint members 901 and 1101, respectively, may be formed from a resilient polymeric plastic material. The female joint member 1101 also has a female joint member connection plug 1104.

Figure 13:
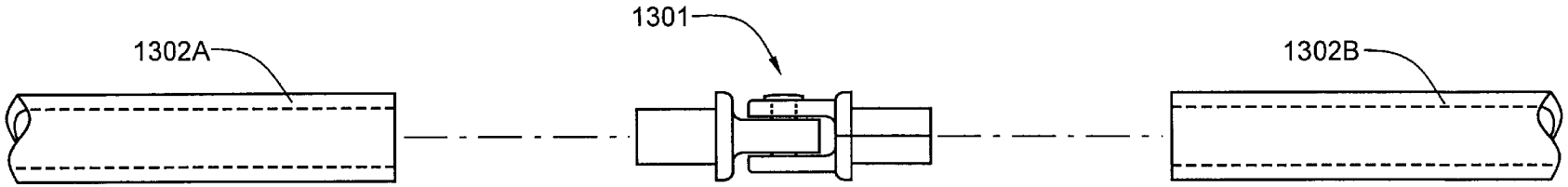
FIG. 13 is an exploded elevational view of an assembled joint and two tube sections into which the assembled joint will be inserted and adhesively bonded.

Referring now to FIG. 13, an assembled geared joint 1301, consisting of a female joint member 1101 engaged with a male joint member 901, is positioned between two tubular elongate members 1302A and 1302B to which it will be subsequently assembled. These tubular elongate members may be identical or nearly identical to tubular elongate members 104A and 104B, the difference, if any, being length. The assembled joint 1301 has two connection plugs: connection plug 902, that is associated with the male joint member 901 and connection plug 1104, that is associated with the female joint member 1101.

Figure 14:
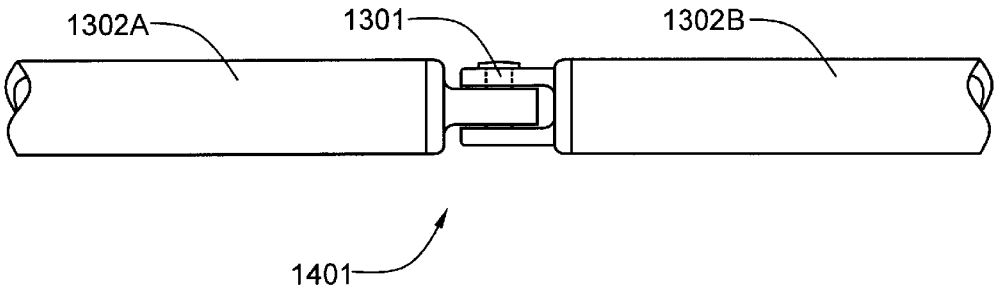
FIG. 14 is a side elevational view of an assembled joint in combination with two tubes which it interconnects.

Referring now to FIG. 14, the assembled joint 1301 has been adhesively bonded to each of the two tubular elongate members 1302A and 1302B to create a joint and tube assembly 1401.

Figure 15:
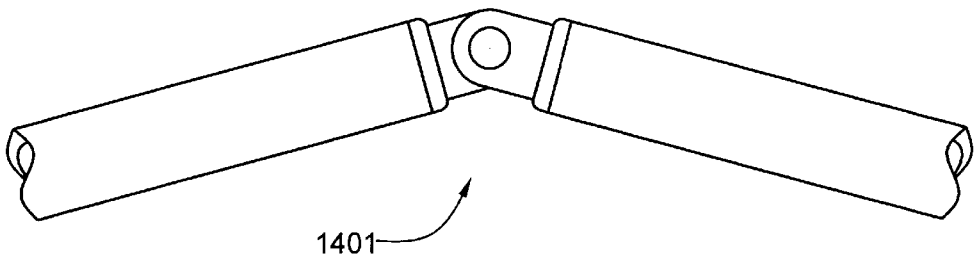
FIG. 15 is a top plan view of the assembled joint and tubes of FIG. 14, showing the tubes in an obtuse angle configuration.

Referring now to FIG. 15, the joint tube assembly 1401 is shown in an obtuse angle configuration.

Figures 16, 17, 18:
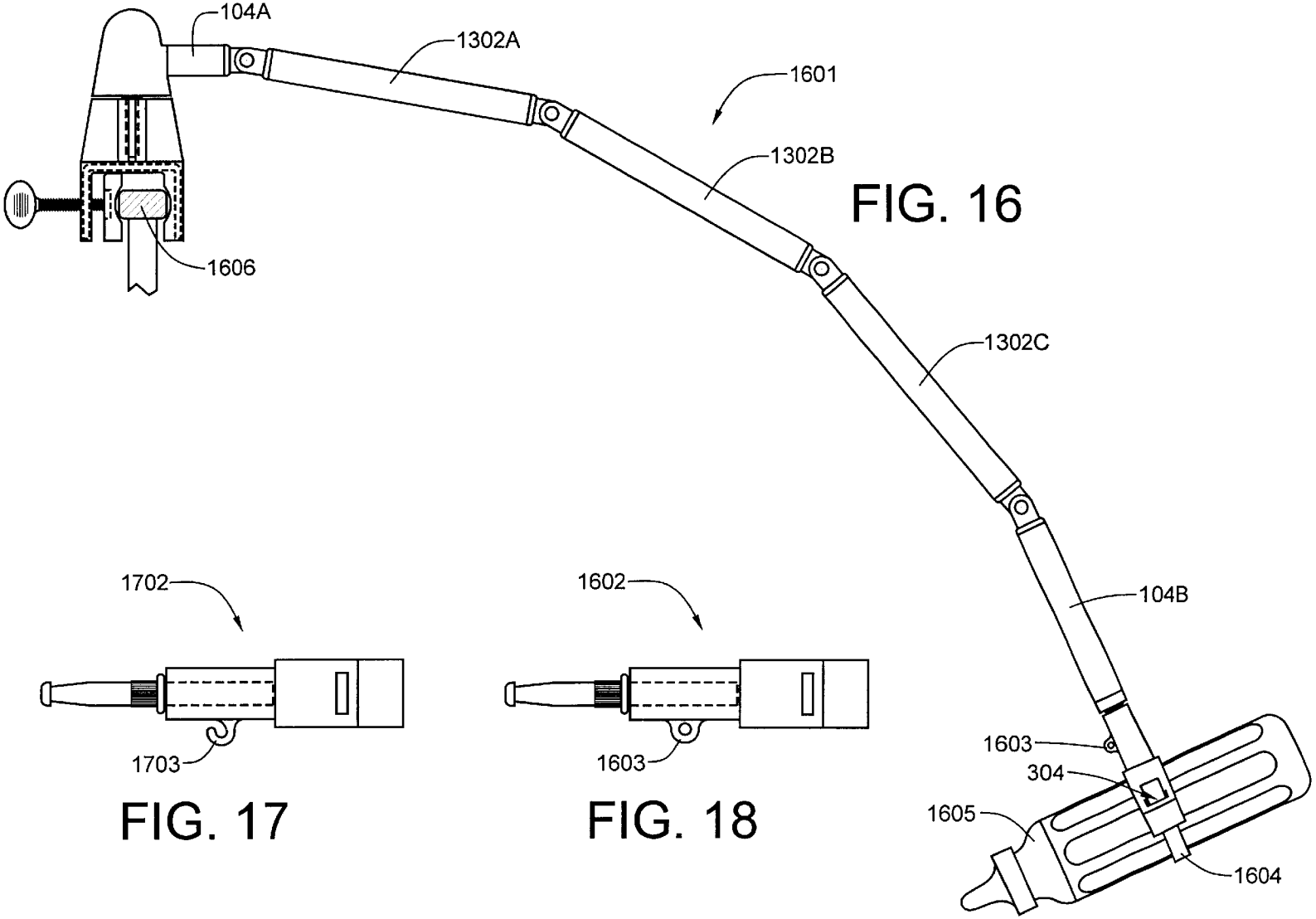
FIG. 16 is a side elevational view of a first embodiment bottle holder having a hook which may be used to suspend a mobile.
FIG. 17 is a side elevational view of a second embodiment bottle holder having an eye which may be used to suspend a mobile.
FIG. 18 is a completed infant nursing bottle holder, in combination with a nursing bottle attached to the bottle holder with a strap.

Referring now to FIG. 16, a completely assembled infant nursing bottle holder 1601, having a first embodiment bottle retainer 1602 with an eye 1603 for the support of a mobile (not shown in this drawing figure), is shown. The apparatus comprises four geared joints 1301A, 1301B, 1301C, and 1301D, three equal-length tubular elongate members 1302A, 1302B, and 1302C, and two shorter tubular elongate members 104A and 104B. The remaining components are numbers consistent with the elements heretofore described with reference to the earlier drawing figures. A strap 1604 is shown anchored to one of the strap receiving slots 304 and holding a bottle 1605 to the bottle retainer 1602. The clamp 101 is attached to a member 1606, such as the rail of a crib.

Referring now to FIG. 17, a second embodiment Y-shaped bottle retainer 1702 incorporates a hook 1703 rather than an eye 1603 for supporting a mobile.

Referring now to FIG. 18, the first embodiment Y-shaped bottle retainer 1602 is separately shown.

Figure 19:
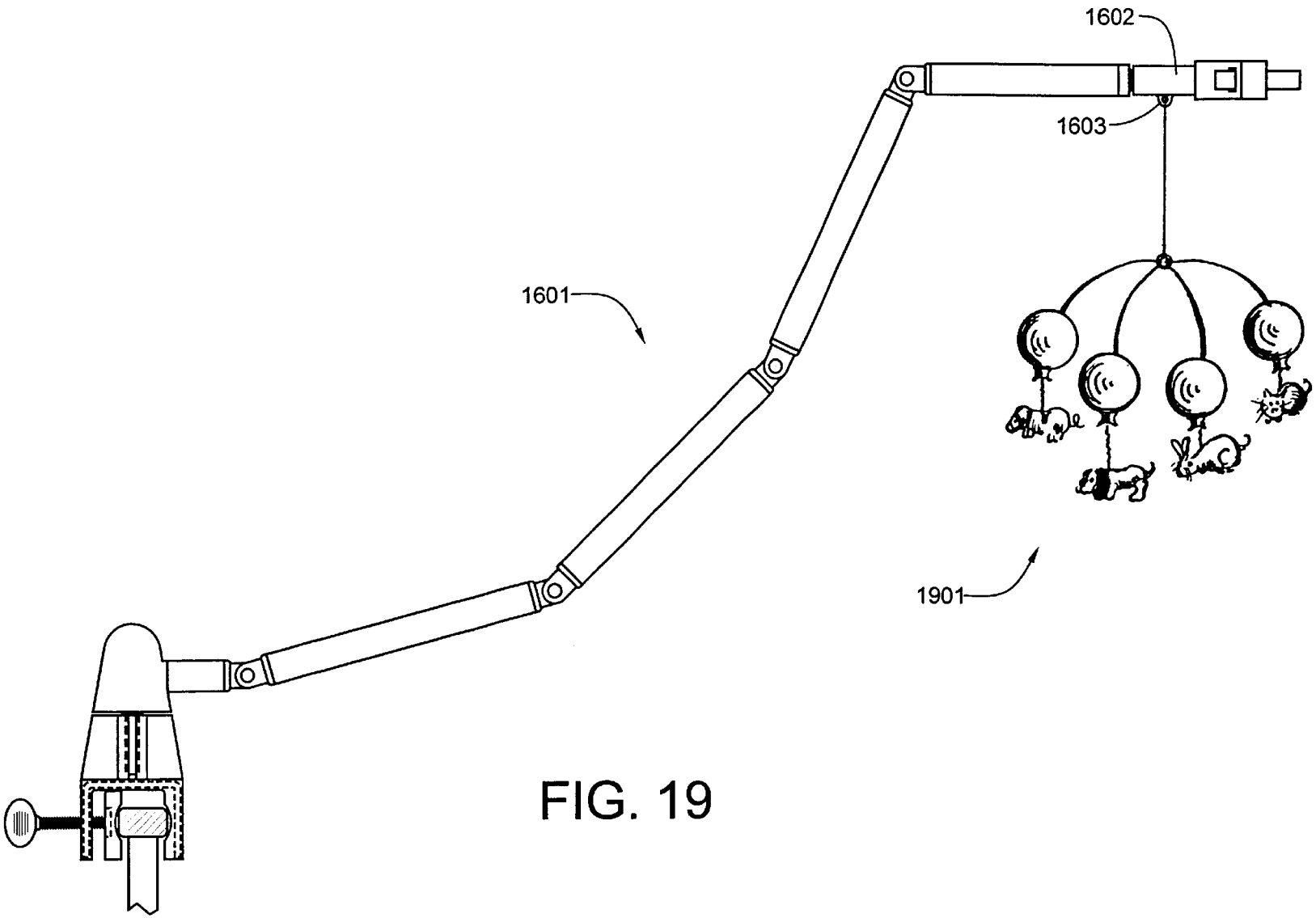
FIG. 19 is the completed infant nursing bottle holder of FIG. 18, with the nursing bottle removed and with a mobile suspended from the eye of a second embodiment bottle holder.

Referring now to FIG. 19, the bottle 1605 has been removed from the bottle retainer 1602 and the infant nursing bottle holder is functioning as a support for a mobile 1901.

Although only several embodiments of the infant nursing bottle holder have been heretofore shown and described, it will be obvious to those having ordinary skill in the art that changes and modifications may be made thereto without departing from the scope and the spirit of the invention as hereinafter claimed.

What is claimed is:

1. An infant nursing bottle holder comprising:

a substantially U-shaped clamping member;

a nursing bottle-retaining member;

means for securing an infant nursing bottle to said bottle-retaining member;

a plurality of elongate members, interconnected end-to-end and, together, coupling said bottle-retaining member to said U-shaped clamping member;

a rotatable hinge joint at the interconnection of each pair of elongate members, each hinge joint having a resilient first hinge member affixed to one of each pair of interconnected elongate members, said first hinge member having an internally geared aperture with a first set of evenly-spaced teeth; and a second hinge member including a pair of parallel, spaced-apart hinge plates affixed to the other of said pair of elongate members, said second hinge member further including an externally geared pivot shaft with a second set of teeth, said pivot shaft positioned within the internally geared aperture with the first and second sets of teeth mutually engaged, each end of said pivot shaft being rigidly and non-rotatably coupled to one of said hinge plates.

2. The infant nursing bottle holder of claim 1, wherein each rotatable hinge joint is capable of incrementally discrete arcuate positioning over a range greater than 180 degrees.

3. The infant nursing bottle holder of claim 1, which further comprises a first swivel joint rotatable through an arc of 360 degrees interposed between said clamping member and an elongate member.

4. The infant nursing bottle holder of claim 3, which further comprises a second swivel joint rotatable through an arc of 360 degrees interposed between said nursing bottle retaining member and an elongate member.

5. The infant nursing bottle of claim 4, wherein said first and second swivel joints each comprise:

a first male snap connector affixed to said clamping member; and a first female snap connector mated to said first male snap connector, said first female snap connector having a stub post to which is secured one end of an elongate member.

6. The infant nursing bottle holder of claim 5, wherein said first female snap connector is dome shaped, axially swivelable, and said stub post is perpendicular to the swivel axis.

7. The infant nursing bottle holder of claim 4, wherein said first and second male snap connectors are pivot shafts having a domed end with an abrupt annular shoulder, each of said pivot shafts having an externally geared annular region with a third set of evenly-spaced teeth, and said first and second female snap connectors are resilient tubular members having an annular collar sized to stretchably slip over the domed end of a pivot shaft and, then, return to its normal size in a locked position beneath the annular shoulder of the pivot shaft.

8. The infant nursing bottle holder of claim 7, wherein said nursing bottle-retaining member is substantially Y-shaped, with said second swivel joint axially aligned with the base of said Y-shaped member and the arms of said Y-shaped member providing a channel within which an infant nursing bottle may be secured.

9. The infant nursing bottle holder of claim 1, wherein said nursing bottle retaining member further comprises an attachment means affixed thereto for a mobile, said attachment apparatus being selected from the group consisting of a hook and an eye.

10. An infant nursing bottle holder comprising:

a substantially U-shaped clamping member;

a substantially Y-shaped nursing bottle-retaining member;

means for securing an infant nursing bottle to said bottle-retaining member;

a plurality of elongate members, interconnected end-to-end and, together, coupling said bottle-retaining member to said U-shaped clamping member;

a rotatable hinge joint at the interconnection of each pair of elongate members, each hinge joint having a geared pivot with at least one deformable resilient hinge member that permits angular positioning of the joined elongate members at discrete arcuate intervals through a range of at least 180 degrees.

11. The infant nursing bottle holder of claim 10, wherein said U-shaped clamping member comprises a central portion and first and second generally parallel and opposed extensive portions integral with the central portion, said first extensive portion having a threaded aperture, said clamping member also including a threaded thumbscrew mateable with said threaded aperture, said thumbscrew being linearly reversably movable perpendicular to said extensive portions.

12. The infant nursing bottle holder of claim 10, wherein each rotatable hinge joint comprises:

a resilient first hinge member affixed to one of each pair of interconnected elongate members, said first hinge member having an internally geared aperture with a first set of evenly-spaced teeth; and a second hinge member including a pair of parallel, spaced-apart hinge plates affixed to the other of said pair of elongate members, said second hinge member further including an externally geared pivot shaft with a second set of teeth, said pivot shaft positioned within the internally geared aperture with the first and second sets of teeth mutually engaged, each end of said pivot shaft being rigidly and non-rotatably coupled to one of said hinge plates.

13. The infant nursing bottle holder of claim 10, which further comprises a first swivel joint rotatable through an arc of 360 degrees interposed between said clamping member and an elongate member.

14. The infant nursing bottle holder of claim 13, which further comprises a second swivel joint rotatable through an arc of 360 degrees interposed between said nursing bottle retaining member and an elongate member.

15. The infant nursing bottle of claim 14, wherein said first and second swivel joints each comprise:

a first male snap connector affixed to said clamping member; and a first female snap connector mated to said first male snap connector, said first female snap connector having a stub post to Which is secured one end of an elongate member.

16. The infant nursing bottle holder of claim 15, wherein said first resilient female snap connector is dome shaped, axially swivelable, and said stub post is perpendicular the swivel axis.

17. The infant nursing bottle holder of claim 14, wherein said first and second male snap connectors are pivot shafts having a domed end with an abrupt annular shoulder, each of said pivot shafts having an externally geared annular region with a third set of evenly-spaced teeth, and said first and second female snap connectors are resilient tubular members having an annular collar sized to stretchably slip over the domed end of a pivot shaft and, then, return to its normal size in a locked position beneath the annular shoulder of the pivot shaft.

18. The infant nursing bottle holder of claim 17, wherein said nursing bottle-retaining member is substantially Y-shaped, with said second swivel joint axially aligned with the base of said Y-shaped member and the arms of said Y-shaped member providing a channel within which an infant nursing bottle may be secured.

19. The infant nursing bottle holder of claim 18, wherein said means for securing is a strap, and each of the arms of said Y-shaped member incorporates a barbed rectangular tubular member for securing an end of said strap.

20. The infant nursing bottle holder of claim 10, wherein said nursing bottle retaining member further comprises an attachment means affixed thereto for a mobile, said attachment apparatus being selected from the group consisting of a hook and an eye.

* * * * *